United States Patent [19]

Childers

[11] Patent Number: 4,967,208

[45] Date of Patent: Oct. 30, 1990

[54] OFFSET NOZZLE DROPLET FORMATION

[75] Inventor: Winthrop D. Childers, San Diego, Calif.

[73] Assignee: Hewlett-Packard Company, Palo Alto, Calif.

[21] Appl. No.: 326,397

[22] Filed: Mar. 21, 1989

Related U.S. Application Data

[63] Continuation of Ser. No. 83,761, Aug. 10, 1987, abandoned.

[51] Int. Cl.[5] ..... B41J 2/05; B41J 2/145

[52] U.S. Cl. ..... 346/140 R

[58] Field of Search ..... 346/140

[56] References Cited

U.S. PATENT DOCUMENTS

| | | | |
|---|---|---|---|
| 4,330,787 | 5/1982 | Sato | 346/140 |
| 4,514,741 | 4/1985 | Meyer | 346/140 |
| 4,587,534 | 5/1986 | Saito | 346/140 |
| 4,611,219 | 9/1986 | Sugitani | 346/140 |
| 4,794,411 | 12/1988 | Taub | 346/140 |

*Primary Examiner*—Joseph W. Hartary

*Attorney, Agent, or Firm*—Roland I. Griffin

[57] ABSTRACT

A device, particularly useful for thermal ink-jet printheads, for improving the repeatability of droplet volume is disclosed. Offsetting a nozzle from its corresponding ink heating element perpendicularly to the flow if ink across the element has been found to significantly reduce the ejected droplet volume deviation.

2 Claims, 2 Drawing Sheets

OFFSET NOZZLE DROPLET FORMATION

CROSS REFERENCE TO RELATED APPLICATION

This application is a continuation of application Ser. No. 083,761, filed Aug. 10, 1987, now abandoned.

BACKGROUND OF THE INVENTION

1. Field of the Invention

The present invention relates generally to hydrodynamics of droplet formation and, more particularly, to a printhead design that enhances performance of thermal ink-jet pens.

2. Description of the Related Art

The art of thermal ink-jet (TIJ) printhead fabrication is relatively well developed. The basics are disclosed, for example, in some detail in the *Hewlet-Packard Journal*, Vol. 36, No. 5, May 1985, incorporated herein by reference.

In the field of TIJ printing, it is known to provide a printhead having an orifice plate in combination with heating elements such that thermal excitation of ink is used to eject droplets through tiny nozzles onto a print media. The orifice plate configuration is one of the design factors that controls droplet size, velocity and trajectory.

In the prior art, it is known to align printhead orifice plate nozzles with underlying heating elements as shown in FIGS. 1 and 2. Heat from an element 2 causes a vapor bubble to grow rapidly in an ink channel 4 and gives momentum to the ink above the bubble. The ink in turn is propelled through a nozzle 6 in an orifice plate 8 and onto the print media.

One of the problems associated with TIJ printing is obtaining repeatability of the ejected ink droplet size. In general, a droplet volume will have deviation of about four to eight percent in such a design arrangement as shown in the FIGURES.

Hence, there is a need to improve repeatability of ink droplet volume in order to improve print quality and uniformity.

SUMMARY OF THE INVENTION

It is an advantage of the present invention that it improves volume repeatability of ink droplets ejected by a TIJ printhead nozzle.

A further advantage of the invention is that it reduces droplet tail spray.

Another advantage of the invention is that it improves print area fill and, thus, the printed text quality.

Yet another advantage of said invention is that in ink-jet technology it significantly improves the qualtiy of pens by reducing ink droplet volume variations of individual nozzles, across pens, and between pens.

In a basic aspect, the present invention provides a device for ejecting fluid in droplet form, having a substrate, heating means on said substrate for thermally exciting said fluid, and ejecting means superposing said substrate for ejecting said fluid in droplet form, wherein said ejecting means has an aperture or nozzle, the center of which overlays the heating element but is offset from the center of said heating means in a direction perpendicular to the direction of flow of said fluid across said heating means.

Other objects, features and advantages of the present invention will become apparent upon consideration of the following detailed description and the accompanying drawings, in which like reference designations represent like features throughout the FIGURES.

The drawings referred to in this description should be understood as not being drawn to scale except if specifically noted.

DETAILED DESCRIPTION OF THE INVENTION

Figure 1:
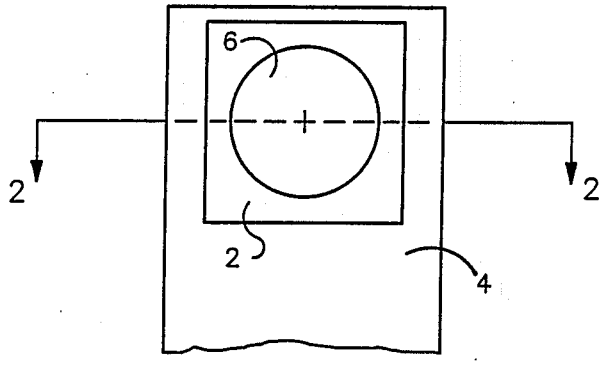
FIG 1 (PRIOR ART)
FIG. 1 is a schematic plan view showing a prior art fluid channel, heating element, and nozzle configuration for a printhead.
Figure 3:
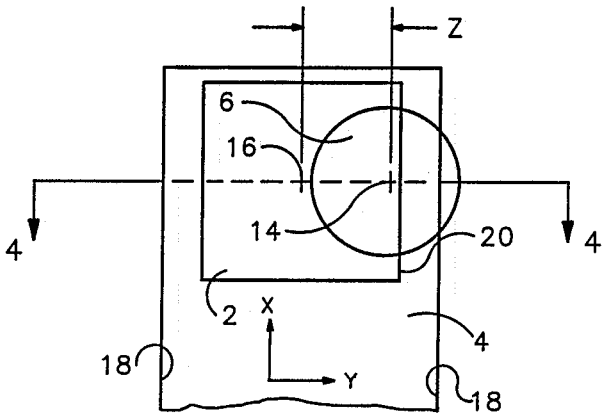
FIG. 3 is a schematic plan view showing a fluid channel, heating element, and nozzle configuration for a printhead in accordance with the present invention.
Figure 2:
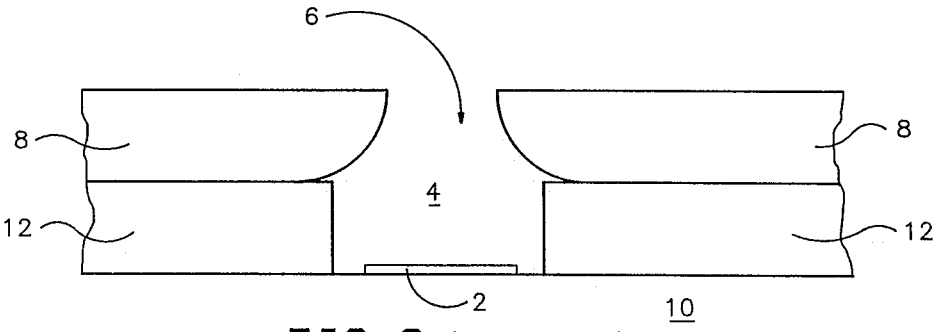
FIG 2 (PRIOR ART)
FIG. 2 is a schematic drawing taken in plane A—A of FIG. 1.
Figure 4:
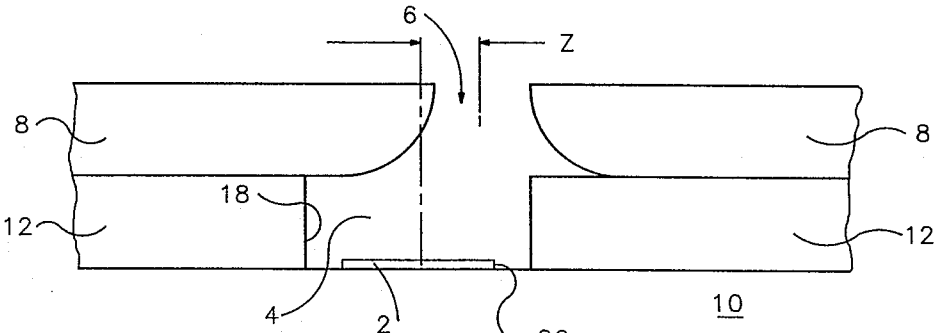
FIG. 4 is a schematic drawing taken in plane B—B of FIG. 3.

Reference is made now in detail to a specific embodiment of the present invention, which illustrates the best mode presently contemplated by the inventor for practicing the invention. Alternative embodiments are also briefly described as applicable. Referring now to FIGS. 3 and 4, a substrate 10 forms the base member for a TIJ printhead. In the state of the art, it is known to fabricate printhead structures using techniques common to the fabrication of thin film and semiconductor devices, such as integrated circuits. As such, a detailed description of those processes is not essential to an understanding of the present invention.

Superposing the substrate 10, a barrier layer 12 is formed to include 1 feed channel 4 to direct ink flow from a connected reservoir (not shown). In the ink channel 4, substantially geometrically centrally located widthwise, is a heating element 2. Thin film resistors functioning as heating elements are known to provide adequate thermal energy to stimulate various printing inks for ink drop ejection. It is known in the state of the art of thin film technology to fabricate thin film structures for TIJ printheads which include resistors, interconnections and passivation layers. An orifice plate 8 overlays the barrier layer 12.

As best shown in FIG. 3 (showing x, longitudinal, and y, lateral, reference coordinates in the ink channel 4), in the present invention, an aperature or nozzle 6 has a centerpoint 14, overlaying the heating element 2, which has been offset from the y centerpoint 16 of the heating element 2 in the y direction by a dimension labelled z, i.e. in the direction of one of the side walls 18 of the channel 4, perpendicular to the longitudinal axis x. Generally, this is perpendicular to the flow of ink in the channel 4.

A TIJ printhead comprises a nozzle plate 8 having a plurality of nozzles 6 with corresponding heating elements 2. The quantity and complexity of the arrangement will be dependent upon the functions required of the particular printer or plotter in which the printhead is to be utilized. The intentional offset of the nozzle 6 in the orifice plate 8, in a direction perpendicular to the longitudinal axis of the ink feed channel 4, in a controlled manner, has been found experimentally to improve repeatability of ejected ink droplet volume. All overall ink droplet volume deviation appears to decrease by a factor of three or four by offsetting the orifice nozzle 6 with respect to the heating element 2 laterally of the feed channel 4.

Exact dimensioning is obviously dependent on the individual design of the printhead. In an exemplary embodiment, where the width of the feed channel 4 has a dimension y=85 microns, the width of the heating element 2 has a dimension y=64 microns, barrier layer 12 has a height of 55 microns, and orifice plate 8 has a height of 62.5 microns with a nozzle diameter of 43 microns and a convex inner surface radius of 62.5 micron, an approximately 25 micron offset, z, of the nozzle centerpoint 14 from the heating element centerpoint 16, perpendicular to the longitudinal axis of the channel 4, yields optimum performance. This offset of approximately 25 microns is less than one-half of the width (32 microns) of the heating element 2 from its center point to a side edge thereof, as also seen in FIG. 3, dimension Z. Expressing 10 microns and 25 microns as percentages of half the width (32 microns) of the heating element 2, results in about 31% and about 78%, respectively. Performance improvement is noticed, however, when the nozzle is offset by about ten microns or more. From experimental data from which this example is provded, performance appears to degenerate once the nozzle centerpoint 14 passes the side edge 20 of the heating element 2.

FIG. 3 shows the offset, described above, of the nozzle 6 laterally of the channel 4 and of the heating element 2, with the nozzle centerpoint 14 positioned adjacent to but within the side edge 20 of the heating element 2, approximating the optimum performance position noted above.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. This embodiment, representing the best mode for practicing the invention, provides a basis to best explain the principles of the invention so that its sprirt and scope, as well as its practical application may be appreciated, to thereby enable others skilled in the art to practice the invention in particular circumstances.

What is claimed is:

1. An ink jet printhead for ejecting ink in droplet form, including an ink channel for directing a flow of ink and orifice means having at least one nozzle superposing said ink channel, the improvement for ejecting droplets of said ink from said one nozzle of substantially repeatable ink droplet volume, comprising:

only one heating element for said one nozzle, said one heating element having a width less than the width of said ink channel and is substantially centrally located widthwise in said ink channel; and said one nozzle in said orifice means having a centerpoint which is offset from the centerline of said heating element a distance within the range of about 31% to about 78% of one-half of the width of said heating element, in a direction substantially perpendicular to the direction of flow of said ink in said ink channel.

2. An ink jet printhead for ejecting droplets of ink of substantially repeatable volume, comprising:

an orifice plate including at least one nozzle therein;

means forming an ink channel in said printhead including said orifice plate for directing the flow of ink to said one nozzle;

only one heating element for said one nozzle, said one heating element having a width less than the width of said ink channel and being disposed in said ink channel substantially centrally of the width thereof;

said one nozzle having a nozzle centerpoint which is offset from the centerline of said heating element in a direction substantially perpendicular to the direction of flow of ink in said channel at a distance from said centerline of about 78% of one-half the width of said heating element.

* * * * *